United States Patent [19]

Bosne

[11] 4,416,835

[45] Nov. 22, 1983

[54] DEVICE FOR RECEIVING A FREE FALLING LIQUID AND THE APPLICATION THEREOF IN A COUNTERCURRENT LIQUID AND GAS COOLING DEVICE

[75] Inventor: Jacques G. P. E. Bosne, Viroflay, France

[73] Assignee: Hamon-Sobelco, S.A., Brussels, Belgium

[21] Appl. No.: 455,253

[22] Filed: Jan. 3, 1983

Related U.S. Application Data

[62] Division of Ser. No. 319,372, Nov. 9, 1981, Pat. No. 4,385,010.

[30] Foreign Application Priority Data

Nov. 12, 1980 [FR] France ..... 80 24018

[51] Int. Cl.[3] ..... B01F 3/04

[52] U.S. Cl. ..... 261/110; 261/DIG. 85; 52/11; 405/119

[58] Field of Search ..... 261/110, 111, DIG. 11, 261/DIG. 85; 405/119; 52/11, 12

[56] References Cited

U.S. PATENT DOCUMENTS

| | | | |
|---|---|---|---|
| 883,632 | 3/1908 | Feyler | 52/12 |
| 1,647,281 | 11/1927 | Doyle | 261/111 |
| 2,209,741 | 7/1940 | Sullivan et al. | 52/11 |
| 2,288,121 | 6/1942 | Cisar et al. | 52/12 |
| 2,626,129 | 1/1953 | Obert | 261/111 |
| 2,669,950 | 2/1954 | Bartholomew | 52/12 |
| 3,081,987 | 3/1963 | Meek et al. | 261/DIG. 11 |
| 3,290,867 | 12/1966 | Jacir | 261/110 |
| 3,611,731 | 10/1971 | Edmondson | 52/11 |
| 4,215,080 | 7/1980 | Ribiner et al. | 261/111 |

FOREIGN PATENT DOCUMENTS

| | | | |
|---|---|---|---|
| 25583 | 11/1969 | Australia | 52/11 |
| 1484382 | 11/1969 | Fed. Rep. of Germany | 405/119 |
| 2250776 | 10/1972 | Fed. Rep. of Germany . | |
| 876525 | 11/1942 | France . | |
| 54-137116 | 10/1979 | Japan | 52/16 |
| 451216 | 5/1968 | Switzerland . | |
| 734185 | 7/1955 | United Kingdom . | |
| 1047454 | 11/1966 | United Kingdom . | |

*Primary Examiner*—Tim R. Miles

*Attorney, Agent, or Firm*—Kerkam, Stowell, Kondracki & Clarke

[57] ABSTRACT

The invention provides a device for receiving a liquid which falls freely in the form of a shower or the like, of the type comprising a receiving wall which is inclined to the vertical and directs the received liquid into a trough which extends along the lower edge of the receiving wall. The devices comprise in the flow path of the liquid received on the inclined wall and before the liquid enters the trough, means for substantially reducing or eliminating the vertical velocity component of the liquid when it enters the trough.

The disclosure is also directed to such a device employed in countercurrent installations for putting a liquid in contact with a gas.

4 Claims, 11 Drawing Figures

DEVICE FOR RECEIVING A FREE FALLING LIQUID AND THE APPLICATION THEREOF IN A COUNTERCURRENT LIQUID AND GAS COOLING DEVICE

This is a division of application Ser. No. 319,372, filed Nov. 9, 1981 now U.S. Pat. No. 4,385,010, granted May 24, 1983.

TECHNICAL FIELD

The present invention relates to countercurrent gas and liquid contact apparatus and in particular those employed for cooling a liquid, such as water, by means of the air of the atmosphere, and more particularly the invention concerns a device for receiving a liquid which falls freely in the form of a shower or the like in such installations.

BACKGROUND OF THE PRIOR ART

Countercurrent gas and liquid contact installations generally comprise a chamber provided in its lower part with at least one gas inlet opening and in its upper part with at least one gas outlet opening and, inside said chamber, a liquid distributing system, a unit for putting the liquid in direct contact with the gas disposed under the distributing system, and means for receiving the liquid which flows in a free fall in the form of a shower or the like from the contacting unit. These means may be formed by a basin provided at the base of the chamber and into which the liquid falls directly. However, such a basin has the drawback of being of relatively expensive construction, of generating considerable noise due to the liquid falling through a considerable height from the contacting unit onto the liquid in the basin, and of requiring high pumping power for directly or indirectly recycling the liquid from the basin to the distributing system. In an attempt to overcome these drawbacks, it is already known, in particular from French Pat. No. 876,525, to employ liquid receiving devices which are disposed immediately below the exchange unit and each comprise a liquid receiving wall which is inclined to the vertical and pours the liquid received into a trough which extends along the lower edge of the wall. A number of these devices are disposed parallel to each other and overlap, so as to prevent any direct fall of the liquid from the exchange unit to the base of the tower, and pour the collected liquid at one of their ends into a trough then into a final collector.

However, with the receiving devices of the prior art, there is observed poor flow of the collected liquid in the troughs. This has usually resulted in the provision of secondary collectors for avoiding, to some extent, clogging of the troughs.

BRIEF SUMMARY OF THE INVENTION

An object of the present invention is to provide means to improve the flow of the liquid in the troughs of collectors and is based on the discovery that poor flow is due to considerable disturbances which are created by the liquid flowing from the inclined walls of the collector and entering the mass of liquid flowing in the troughs.

Accordingly, the present invention provides a device for receiving a liquid which falls freely in the form of a shower or the like, of the type comprising a wall which is inclined to the vertical and a trough, hereinafter termed a main trough, extending along the lower edge of the wall, characterized in that it comprises, in the path of the liquid received by the inclined wall, and before its entry into the liquid in the main trough, means for markedly reducing or eliminating the vertical velocity component of the liquid.

According to a first embodiment, the means for reducing or eliminating the vertical velocity component of the liquid comprise deflecting surfaces which impart to the liquid, as its entry into the main trough, a substantial velocity component in the direction of flow of the liquid in the main trough.

The deflecting surfaces may be, for example, formed by inclined small troughs or buckets, disposed at the entrance of the main trough, which impart to the liquid a direction and velocity close to that of the flow of liquid in the main trough. The deflecting surfaces may also be formed by ribs disposed on the inclined wall along the line of greatest slope, the lower part of which is curved in the direction of the flow of the liquid in the main trough or by ribs disposed on the inclined wall which ribs are inclined in the direction of the flow of the liquid in the main trough. Such deflecting surfaces cause the liquid to change direction in the direction of the flow in the main trough and impart thereto a velocity which may be higher than that of the liquid in the main trough. In this way, disturbances in the flow in the main trough are reduced, and the flow of the liquid in the main trough may also be accelerated.

According to another embodiment, the means for reducing or eliminating the vertical velocity component comprise one or more obstances which tend to eliminate the velocity component of the liquid prior to its entry into the main trough.

It has been found that it is unnecessary, in order to improve the flow, to impart to the liquid entering the main trough a velocity component in the direction of the flow in the main trough, but that it is sufficient to substantially reduce or eliminate the vertical velocity component and, for this purpose, the simplest solution resides in reducing or simply eliminating the vertical velocity component of the liquid before it enters the main trough.

The obstacles may be, for example, formed by studs disposed on the inclined wall, a rib parallel to the main trough and disposed at the entrance of the latter, or, better still, a fine-mesh screen covering the main trough.

It is also possible to combine the two embodiments and to employ small inclined troughs formed by fine-mesh screens.

Another object of the invention is to provide a countercurrent installation for putting a liquid in contact with a gas and comprising a chamber provided in the lower part thereof with at least one gas inlet opening and in the upper part thereof with at least one gas outlet opening and, within said chamber, a liquid distributing system, a unit for putting the liquid directly in contact with the gas disposed under the distributing system, and a liquid receiving system; the liquid receiving system comprising those as defined hereinbefore disposed below said unit for receiving the liquid which flows from the unit.

BRIEF DESCRIPTION OF THE DRAWINGS

Further features and advantages of the invention will be apparent from the ensuing description with reference to the accompanying drawings which are given solely by way of example, and in which.

DETAILED DESCRIPTION OF THE INVENTION

Figure 1:
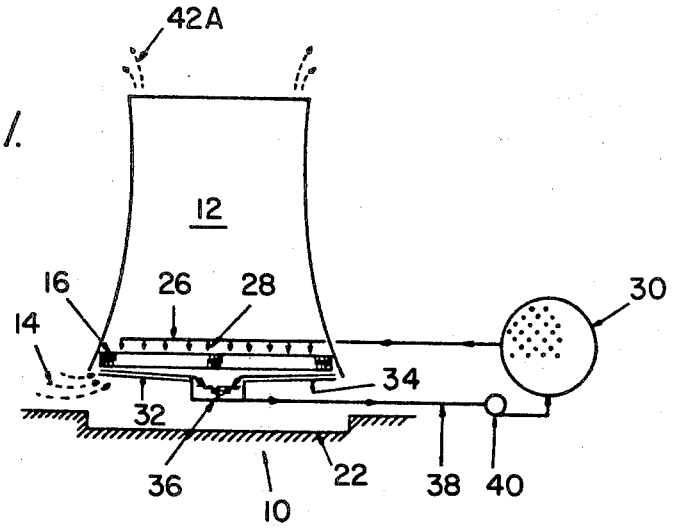
FIG. 1 is a diagrammatic elevation in partial section of a cooling tower system according to the invention.
Figure 2:
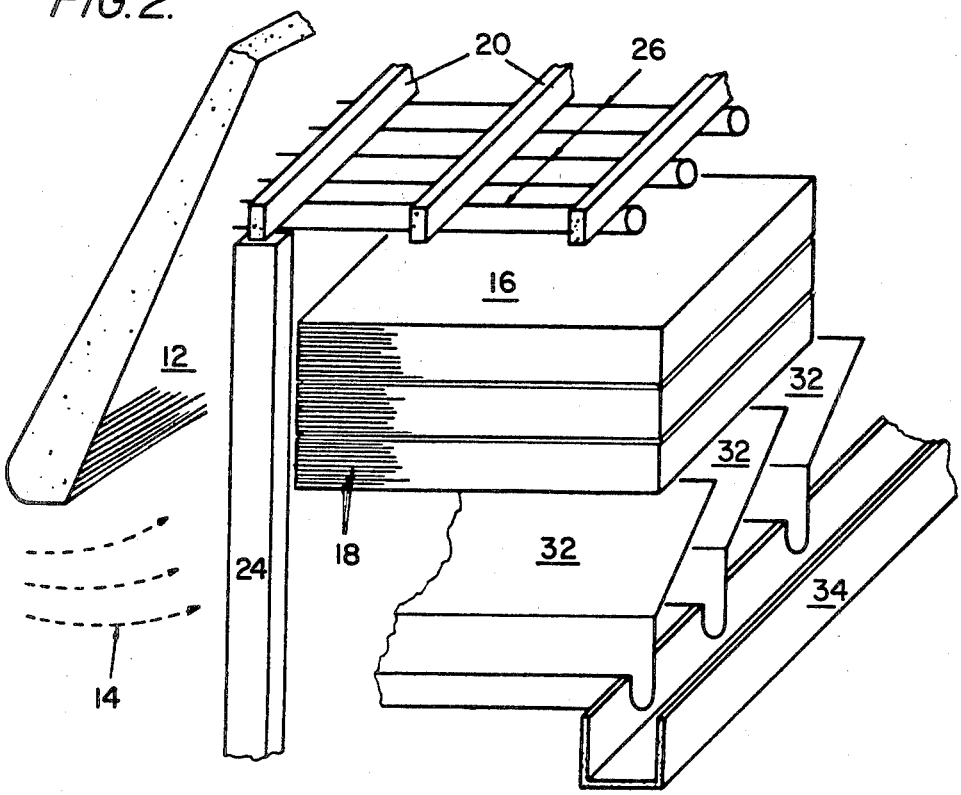
FIG. 2 is a perspective view of a fragmental portion of the cooling tower system shown in FIG. 1.

Referring particularly to FIGS. 1 and 2 of the drawing, 10 generally designates a cooling tower system of the atmospheric type. The system includes a tower 12 of conventional hyperbolic form. Within the tower and above the air inlets 14, about the base thereof, is mounted conventional grids or fill generally designated 16. In the illustrated form the invention, the fill includes a plurality of sheets 18, mounted in spaced relationship to each other to provide for the flow of atmospheric air between the sheets. The fill sheets 18, are supported in a convention manner on a grid or network of beams 20, which are in turn supported by the base 22, of the tower on columns 24.

Above the fill 16, is mounted a grid or network 26, of pipes having spray outlets 28. The grid of pipes 26 is supplied with water to be cooled from a conventional condensor 30, for cooling the exhaust from a power generating turbine, not shown. Mounted below the filling sheets 18 and supported by the grid 20, are a plurality of devices generally designated 32 for receiving the liquid which falls from the filling sheets 18.

Associated with the means for receiving the liquid is a network of primary channel members, generally designated 34, which receive the water from the troughs of the collectors 32, and deliver the collected liquid to a central collector 36, FIG. 1. The central collector 36, is connected by conduit means 38 and pump 40 to the cooling condensor 30.

When the water cooling tower system 10, is in operation, water from the condensor 30 is sprayed from the sprayers 28 onto the sheets 18 where the water forms a film and percolates downwardly until dropping from the lower edges of the bottom grid. The droplets thereafter drip into the liquid receiving devices 32 and from the troughs thereof to be described in reference to FIGS. 3 through 11, the collected liquid is dispensed into the channel elements 34 to collector 36, thence through pipe 38 and pump 40 back to the condensor 30. At the same time atmospheric air enters the tower 12 via the inlets 14 and flows upwardly through the fill 16 as illustrated by the directional arrows A. After passing through the fill the heated air exits from the tower via outlet 42A.

Referring now particularly to FIGS. 3 through 11, the novel devices 32 for receiving a liquid which falls freely in the form of a shower comprise, in the known manner, a wall 42 which is inclined to the vertical and a trough 44, termed a main trough, extending along the lower edge of the inclined wall 42. The inclined wall 42 is planar and is connected to the trough 44 by a curved part 46 which is downwardly extended, in the direction of the trough end by a short vertical part 48. The trough 44 has a curved bottom 60 and two edge portions 52 and 54 on each side of the bottom, the edge portion 52 being an extension of the vertical part 48.

Figure 3:
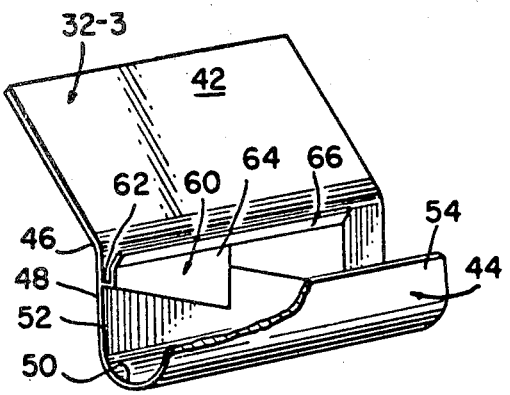
FIGS. 3 to 11 are perspective views of different embodiments of the invention.

The device 32-3 shown in FIG. 3 comprises a horizontal succession of inclined small troughs 60 which are disposed in end-to-end relation on the vertical part 48. Each inclined small trough 60 comprises a flat bottom 62, the back edge of which is fixed to the vertical part 48 and greatly inclined relative to the vertical, and an edge portion 64 which is extended by a horizontal strip 66 which is outwardly inclined from the inclined small trough 60. The upper part of the edge portions 64 and the strip 66 of the successive inclined small troughs are fixed to one another.

The liquid which runs or trickles along the inclined wall 42 is deviated in the region of the vertical part 48, by the bottom 62 of each inclined small trough 60 in a direction parallel to the bottom 62 of the small troughs. The collected or deviated liquid issues from each inclined trough 60 with a materially reduced vertical velocity component and enters the main trough 44 in the direction of the flow of the liquid in the latter.

Figure 4:
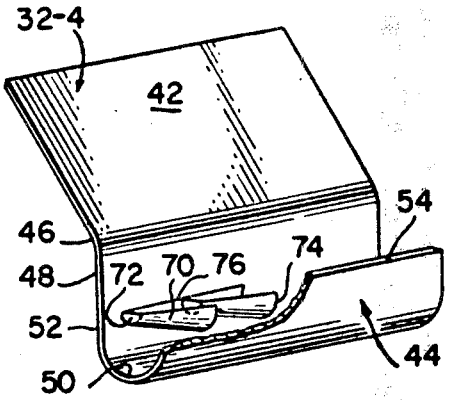

The device shown in FIG. 4 is very similar to that shown in FIG. 3 from which it differs merely by the form of the inclined small troughs. Each inclined small trough 70 comprises a half truncated cone whose small base 72 is closed and whose large base 74 is open. Each inclined small trough is fixed to the part 48 at one of the horizontally disposed upper edge portions 76. As in the case of the device shown in FIG. 3, the liquid is deviated by the bottom of each inclined small trough 70 in a direction parallel to its bottom and issues from each inclined small trough through the large base 74 of the truncated cone with a materially reduced vertical velocity component.

Figure 5:
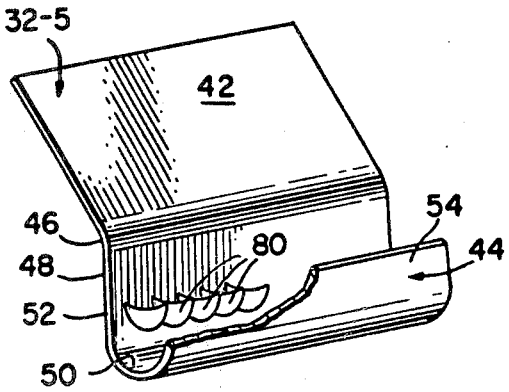

The device 32-5 shown in FIG. 5 comprises a horizontal succession of buckets 80 disposed on the vertical part 48. Each of these buckets is defined by a quarter-sphere. Each bucket 80 deviates the liquid which runs along the wall 42 and directs it into the trough 44 with a substantially reduced vertical velocity component.

Figure 6:
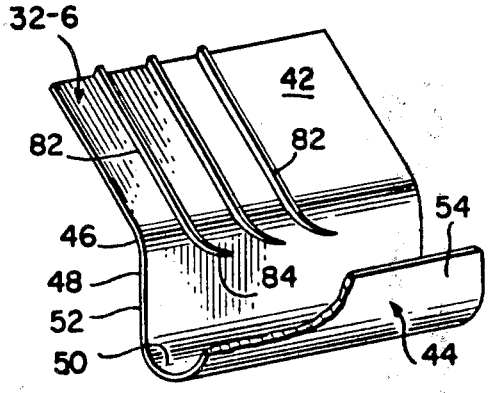

The device 32-6 shown in FIG. 6 comprises a succession of ribs 82 disposed on the inclined wall 44 along the line of greatest slope of the wall. The lower part 84 of each of these ribs 82 in the region of the curved part 46 is curved in the direction of the flow of the liquid in the trough 44 and deviates the liquid running along the wall 42 in the direction of the flow of the liquid in the trough 44.

Figure 7:
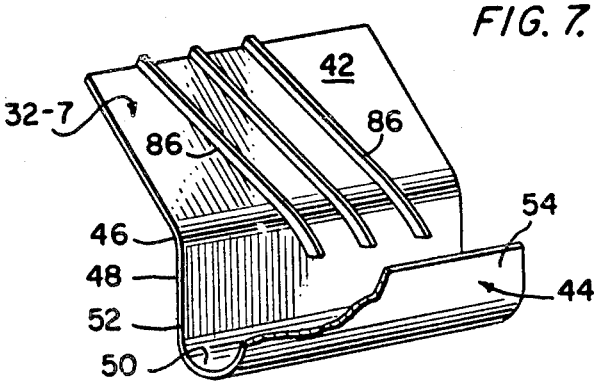

The device 32-7 shown in FIG. 7 comprises a succession of ribs 86 disposed on the wall 42 which ribs extend to the entrance of the trough 44. The ribs 86 are inclined in the direction of the flow of the liquid in the trough 44. By means of these ribs 86, the liquid running along the wall 42 receives a velocity component in the direction of the flow of the liquid in the trough 44.

Figure 8:
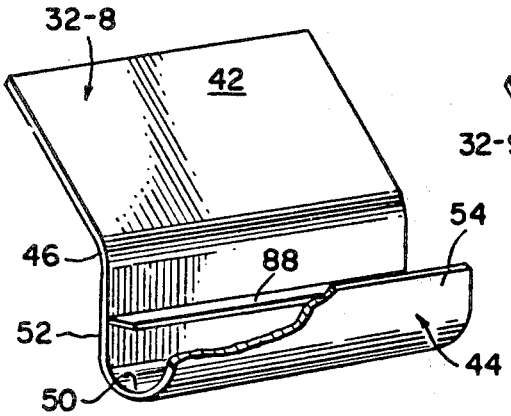

The device 32-8 shown in FIG. 8 comprises a rib 88 which is parallel to the main trough 44 and the rib is disposed at the entrance of the trough 44 on the vertical wall portion 48. This rib 88 breaks the downward flow of the liquid running along the inclined wall 42 when it reaches the trough 44.

Figure 9:
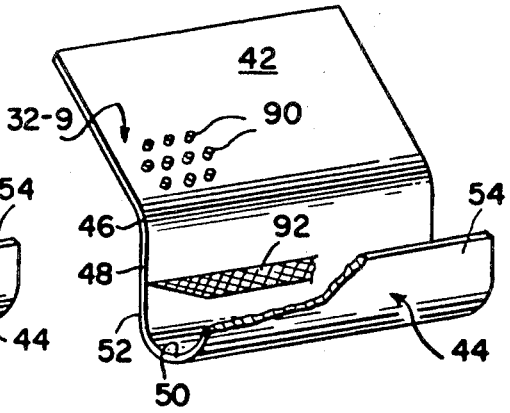

The device 32-9 shown in FIG. 9 comprises, on one hand, studs 90 which project from the inclined wall and are adapted to retard the liquid running along this wall and, on the other hand, a screen 92 having fine meshes formed by a netting of metal wires and covering the trough 44. In the same way as the rib 88, the 92 screen breaks the flow of the liquid in such manner to substantially eliminate the downward velocity of the liquid when it reaches the trough 44.

Figure 10:
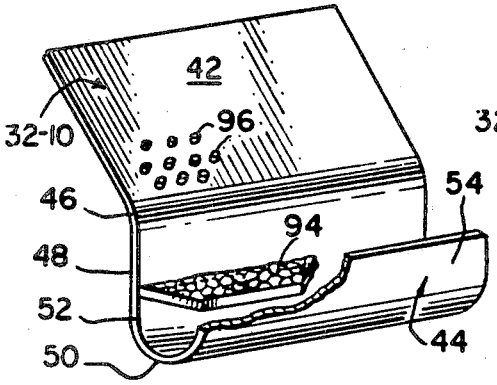

The devices 32-10 shown in FIG. 10 is a modification of that shown in FIG. 9 and comprises, instead of the metal wire screen 92, a screen 94 formed by a plate having vertical passageways. The wall 42 is provided with studs 96, like studs 90 of the FIG. 9 form of the invention.

Figure 11:
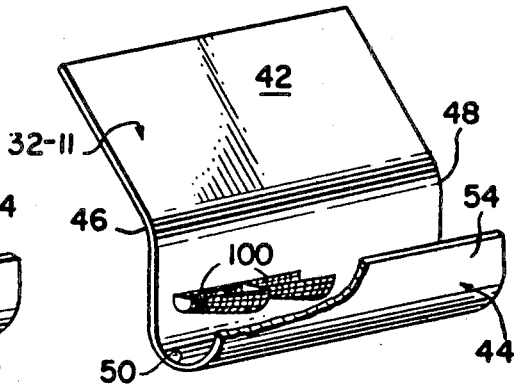

The device 32-11 shown in FIG. 11 is a combination of the devices shown in FIGS. 4 and 9 and comprise a succession of inclined small troughs 100, each in the shape of a semi-truncated cone. The troughs 100, are formed by a netting of metal wires to thereby practically eliminate the downward velocity of the liquid which passes therethrough and deviate the liquid in the direction of the flow of the liquid in the trough 44.

I claim:

1. A device for receiving a liquid falling freely in the form of a shower or the like, comprising receiving wall means consisting of a wall inclined to the vertical and a main trough, extending along the lower edge of the wall, characterized in that said device comprises in the path of the liquid received by the inclined wall and before the liquid enters the bottom of the main trough, means for substantially reducing or eliminating the vertical velocity component of the liquid, wherein the means for substantially reducing or eliminating the vertical velocity component of the liquid comprise liquid deflecting surfaces which impart to the liquid before it reaches the bottom of the main trough a substantial velocity component in the direction of the flow of the liquid in the main trough, and wherein the deflecting surfaces are formed by ribs disposed on the inclined wall along the line of greatest slope, at least a part of said ribs being curved in the direction of the flow of the liquid in the main trough.

2. A device according to claim 1, wherein the lower part of said ribs are curved in the direction of the flow of the liquid in the main trough.

3. A device according to claim 1, wherein the entire length of said ribs are inclined in the direction of the flow of the liquid in the main trough.

4. An installation for putting a liquid in contact with a gas, comprising a chamber provided in the lower part thereof with at least one gas inlet opening and in the upper part thereof with at least one gas outlet opening and, within said chamber, a liquid distributing system, a unit for putting the liquid directly in contact with the gas disposed below the distributing system, and receiving devices disposed below said unit for receiving the liquid which flows therefrom, further characterized in that said receiving devices comprise receiving wall means constructed according to any of claims 2, 3 or 1.

* * * * *